US008581940B2

(12) United States Patent
Kurihara

(10) Patent No.: US 8,581,940 B2
(45) Date of Patent: Nov. 12, 2013

(54) DISPLAY DEVICE

(75) Inventor: Hiroshi Kurihara, Mobara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 603 days.

(21) Appl. No.: 12/496,767

(22) Filed: Jul. 2, 2009

(65) Prior Publication Data

US 2010/0002024 A1 Jan. 7, 2010

(30) Foreign Application Priority Data

Jul. 3, 2008 (JP) ..... 2008-174463

(51) Int. Cl.
*G09G 5/10* (2006.01)

(52) U.S. Cl.
USPC ..... 345/690; 345/89; 345/101

(58) Field of Classification Search
USPC ..... 345/89, 101, 690, 691
See application file for complete search history.

(56) References Cited

U.S. PATENT DOCUMENTS

| | | | | |
|---|---|---|---|---|
| 2004/0135800 | A1 * | 7/2004 | Shiomi et al. | 345/691 |
| 2004/0263450 | A1 * | 12/2004 | Lee et al. | 345/87 |
| 2005/0012731 | A1 * | 1/2005 | Yamazaki et al. | 345/204 |
| 2006/0023519 | A1 * | 2/2006 | Choi et al. | 365/189.09 |
| 2006/0250346 | A1 * | 11/2006 | Ham | 345/101 |
| 2006/0262058 | A1 * | 11/2006 | Hara et al. | 345/89 |

* cited by examiner

*Primary Examiner* — Amare Mengistu
*Assistant Examiner* — Premal Patel
(74) *Attorney, Agent, or Firm* — Antonelli, Terry, Stout & Kraus, LLP.

(57) ABSTRACT

A display device includes a display panel having a plurality of pixels, a drive circuit inputting a drive voltage to the plurality of pixels, and a display control device controlling and driving the drive circuit and to which display data is input from an external apparatus, in which a temperature detecting sensor is included. The display control device has a display bit reduction circuit. In a high-temperature operation mode when a temperature equal to or more than a predetermined temperature is detected at the temperature detecting sensor, the display bit reduction circuit ignores bits other than the highest-order bit of the display data input from the external apparatus and sends only the data of the highest-order bit of the display data input from the external apparatus to the drive circuit.

2 Claims, 9 Drawing Sheets

DISPLAY DEVICE

CROSS-REFERENCE TO RELATED APPLICATION

The present application claims priority from Japanese application JP 2008-174463 filed on Jul. 3, 2008, the content of which is hereby incorporated by reference into this application.

BACKGROUND OF THE INVENTION

1. Field of the Invention

The present invention relates to a display device and more particularly to a technology effectively applied to a display device which operates under high-temperature environment.

2. Background Art

TFT type liquid crystal display devices which use a thin film transistor as an active element have been used as a display device for a television set, a personal computer display, or the like because they can display a high-definition image. Particularly, small TFT type liquid crystal display devices have been frequently used as a display unit for a mobile-phone and an in-vehicle equipment.

A liquid crystal display device for in-vehicle use is required to start display under an environment at 95° C. In such a case, operation under an environment at 100° C. is required at a portion covered with a cover, such as a circuit component.

However, an IC used in a liquid crystal display device, particularly a control IC or the like used as a display control device does not ensure its operation at a temperature exceeding 100° C. Further, in the case of a logic IC, adjustment for reducing a rise in temperature due to voltage or current is also difficult.

Therefore, it is desired that a liquid crystal display device can operate even under high-temperature environment by suppressing a rise in temperature of a circuit component under high-temperature environment.

The invention has been made in view of the desire described above. It is an object of the invention to provide a display device which can operate even under high-temperature environment by suppressing a rise in temperature of a circuit component under high-temperature environment.

The above and other objects of the invention and the novel features thereof will be apparent from the description of the specification and the accompanying drawings.

SUMMARY OF THE INVENTION

Typical outlines of the invention disclosed herein will be briefly described below.

A display device includes a display panel having a plurality of pixels, a drive circuit inputting a drive voltage to the pixels, and a display control device controlling and driving the drive circuit and to which display data is input from an external apparatus. The display device includes a temperature detecting sensor and a display bit reduction circuit. When a temperature equal to or more than a predetermined temperature is detected at the temperature detecting sensor, a high-temperature operation mode is set by the display control device. The display bit reduction circuit sends only the highest-order bit of the display data in the high-temperature operation mode.

The display control device transmits a high-temperature operation signal to the drive circuit in the case of the high-temperature operation mode. The display bit reduction circuit fixes bits other than the highest-order bit of display data to "0" or "1" and sends the display data to the drive circuit in the case of the high-temperature operation mode. The drive circuit outputs the maximum gray scale voltage or the minimum gray scale voltage when notified of the high-temperature operation signal.

The drive circuit has an amplifier circuit which outputs a gray scale voltage based on display data transmitted from the display control device to each of the pixels and an inverter which sets one power supply voltage to the maximum gray scale voltage and sets the other power supply voltage to the minimum gray scale voltage. A control signal based on the highest-order bit of the display data transmitted from the display control device is input to the inverter. The drive circuit outputs an output of the inverter to each of the pixels instead of an output from the amplifier circuit when notified of the high-temperature operation signal.

A display device includes a display panel having a plurality of pixels, a drive circuit supplying a drive voltage to the plurality of pixels, and a display control device controlling and driving the drive circuit and to which display data is input. The display device includes a temperature detecting sensor and a display data thinning circuit. When a temperature equal to or more than a predetermined temperature is detected at the temperature detecting sensor, a high-temperature operation mode is set by the display control device. The display data thinning circuit thins display data input from an external apparatus and sends the display data to the drive circuit in the high-temperature operation mode.

The display panel has a plurality of video lines inputting a gray scale voltage to the plurality of pixels. The drive circuit has a latch unit latching display data corresponding to each of the video lines. The latch unit has a plurality of latch circuits disposed to each of the video lines. Two or more of the latch circuits latch the same display data in the thinned display data when notified of the data thinning signal.

A display device includes a display panel having a plurality of pixels, a drive circuit supplying a drive voltage to the plurality of pixels, and a display control device controlling and driving the drive circuit and to which display data is input from outside. The display device includes a temperature detecting sensor and an alternating signal generating circuit. The display control device operates in a high-temperature operation mode when a temperature equal to or more than a predetermined temperature is detected at the temperature detecting sensor, and a period of an alternating signal to be transmitted to the drive circuit is set longer.

A vertical synchronizing signal is input to the display control device. The display control device monitors the vertical synchronizing signal to switch between a normal operation and the high-temperature operation mode when frames are switched.

A typical effect provided by the invention disclosed herein will be briefly described below.

According to the invention, a display device can operate even under high-temperature environment by suppressing a rise in temperature of a circuit component under high-temperature environment.

DETAIL DESCRIPTION OF THE EMBODIMENTS

Figure 1:
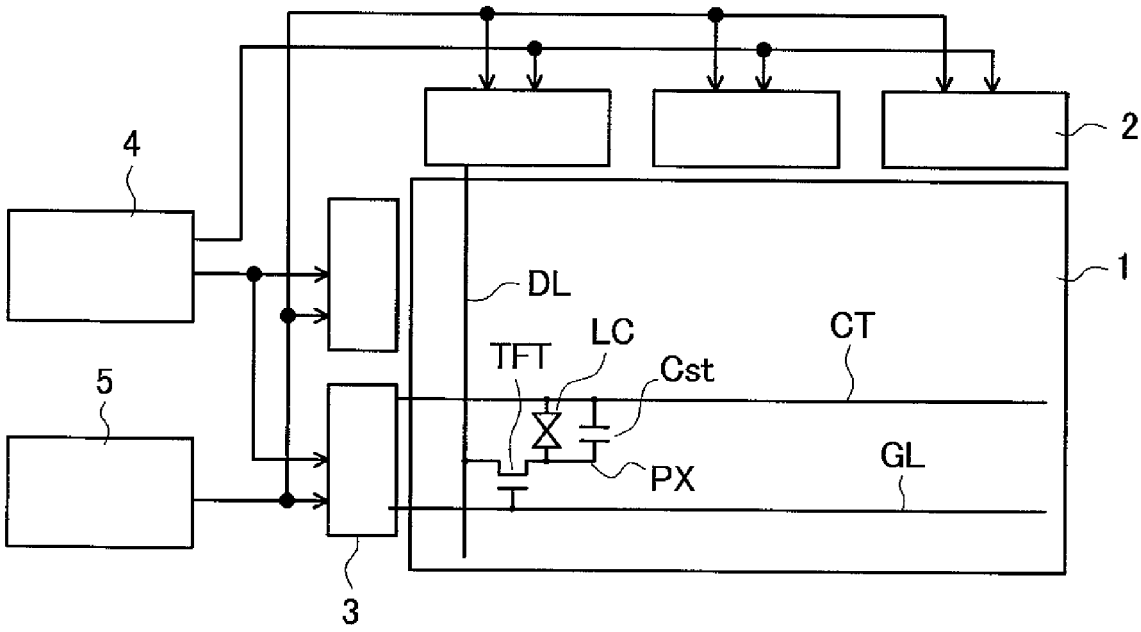
FIG. 1 is a block diagram showing an example of a schematic configuration of a liquid crystal display device as the premise of the invention.

Hereinafter, embodiments of the invention will be described in detail with reference to the drawings.

Throughout the drawings for explaining the embodiments, elements having the same function are denoted by the same reference numerals and signs, and the repetitive description thereof is omitted.

Figure 2:
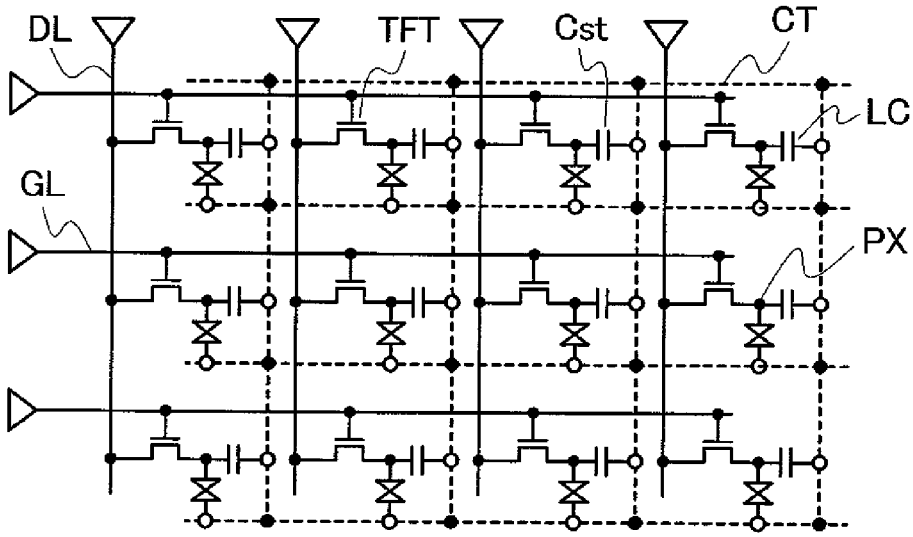
FIG. 2 is a circuit diagram showing an equivalent circuit of a liquid crystal display panel shown in FIG. 1.

FIG. 1 is a block diagram showing a schematic configuration of a liquid crystal display device as the premise of the invention, and FIG. 2 is a circuit diagram showing an equivalent circuit of a liquid crystal display panel 1 shown in FIG. 1.

A liquid crystal display device according to the embodiment includes the liquid crystal display panel 1, a drain driver 2, a gate driver 3, a display control circuit 4, and a power supply circuit 5.

The liquid crystal display panel 1 has a pair of substrates. The gate driver 3 includes a plurality of gate driver ICs arranged on one side of the liquid crystal display panel 1. The drain driver 2 includes a plurality of drain driver ICs arranged on another side of the liquid crystal display panel 1.

For example, the drain driver 2 and the gate driver 3 are mounted respectively at peripheral portions on two sides of a first substrate (for example, a glass substrate) of the liquid crystal display panel 1 by a COG (chip on glass) method. Alternatively, the drain driver 2 and the gate driver 3 are mounted respectively on flexible circuit boards arranged at the peripheral portions on two sides of the first substrate of the liquid crystal display panel 1 by a COF (chip on film) method. Alternatively, the drain driver 2 and the gate driver 3 are mounted at the peripheral portions on two sides of the first substrate of the liquid crystal display panel 1 by a tape carrier package method.

The display control circuit 4 is mounted at a peripheral portion on one side of the first substrate of the pair of substrates of the liquid crystal display panel 1 by the COG method. Alternatively, the display control circuit 4 is mounted on a circuit board arranged at a peripheral portion of the liquid crystal display panel 1 (for example, on the back side of the liquid crystal display device).

The power supply circuit 5 is mounted on a circuit board arranged at a peripheral portion of the liquid crystal display panel 1 (for example, on the back side of the liquid crystal display device). The power supply circuit 5 generates various voltages necessary for the liquid crystal display device.

The display control circuit 4 performs timing adjustment suitable for the display of the liquid crystal display panel 1, such as alternating of data, for a display control signal and display data which are input from a host system (external apparatus) and converts into display data conforming to a display format to input them to the drain driver 2 and the gate driver 3 together with a synchronizing signal (clock signal).

The gate driver 3 sequentially supplies a selection scanning voltage to scanning lines (also referred to as gate lines) GL under the control of the display control circuit 4, and the drain driver 2 supplies a video voltage to video lines (also referred to as drain lines or source lines) DL, to display a video image.

As shown in FIG. 2, the liquid crystal display panel 1 has a plurality of pixels, each of which is disposed in a region surrounded by the video lines DL and the scanning lines GL.

Each of the pixels has a thin film transistor TFT. A first electrode (drain electrode or source electrode) of the thin film transistor TFT is connected to the video line DL, while a second electrode (source electrode or drain electrode) of the thin film transistor TFT is connected to a pixel electrode PX. Agate electrode of the thin film transistor TFT is connected to the scanning line GL.

In FIG. 2, LC denotes a liquid crystal capacitance equivalently showing a liquid crystal layer arranged between the pixel electrode PX and a counter electrode CT, and Cst denotes a holding capacitance formed between the pixel electrode PX and the counter electrode CT.

In the liquid crystal display panel 1 shown in FIG. 1, the first electrode of the thin film transistor TFT of each of the pixels arranged in a column direction is connected to the video line DL. Each of the video lines DL is connected to the drain driver 2 which supplies a video voltage (gray scale voltage) corresponding to display data to the pixels arranged in a column direction.

The gate electrode of the thin film transistor TFT in each of the pixels arranged in a row direction is connected to the scanning line GL. Each of the scanning lines GL is connected to the gate driver 3 which supplies a scanning voltage (positive or negative bias voltage) to the gate of the thin film transistor TFT for one horizontal scanning time.

The display control circuit 4 is formed of one semiconductor integrated circuit LSI and controls and drives the drain driver 2 and the gate driver 3 based on the display control signals of a dot clock DCLK, a display timing signal DTMG, an external horizontal synchronizing signal Hsync, and an external vertical synchronizing signal Vsync and display data which are input from outside.

When the display timing signal DTMG is input, the display control circuit 4 determines the display timing signal DTMG as a signal indicative of a display starting position, and outputs received simple one line of display data to the drain driver 2 via a bus line of the display data.

In that case, the display control circuit 4 outputs a display-data-latch clock signal CL2 which is a display control signal for latching display data to a data latch circuit of the drain driver 2 via a signal line.

When the inputting of the display timing signal DTMG is completed, or a predetermined constant time elapses after the inputting of the display timing signal DTMG, the display control circuit 4 operates assuming that the capturing of display data amounting to one horizontal line is completed. When the capturing of the display data is completed, the display control circuit 4 outputs an output-timing-control clock signal CL1 to the drain driver 2 via a control signal line. In accordance with the output-timing-control clock signal CL1, the drain driver 2 supplies the display data stored in the latch circuit to an output circuit. In accordance with the display data, the output circuit outputs a gray scale voltage to the video line DL of the liquid crystal display panel 1. With this operation, the drain driver 2 supplies a gray scale voltage corresponding to the display data to the video line DL.

Further, when the first display timing signal is input after the inputting of the vertical synchronizing signal, the display control circuit 4 determines the first display timing signal as a signal indicative of the first display line, and outputs a frame starting command signal FLM to the gate driver 3 via a control signal line.

Further, the display control circuit 4 outputs a shift clock CL3 of one horizontal scanning time period to the gate driver 3 via a control signal line based on the horizontal synchronizing signal. The gate driver 3 sequentially supplies a selection scanning voltage (positive bias voltage) to each of the scanning lines GL of the liquid crystal display panel 1 for every horizontal scanning time.

Due to the selection scanning voltage, the plurality of thin film transistors TFT connected to each of the scanning lines GL of the liquid crystal display panel 1 become conductive for one horizontal scanning time.

The voltage supplied to the video line DL is applied to the pixel electrode PX via the thin film transistor TFT for one horizontal scanning time, and eventually electric charge is charged to the holding capacitance Cst and the liquid crystal capacitance LC. Liquid crystal molecules are controlled by an electric field generated between the pixel electrode PX and the counter electrode CT to display an image.

The liquid crystal display panel 1 has the first substrate on which the pixel electrodes PX, the thin film transistors TFT, and the like are formed, and a second substrate (for example, a glass substrate) on which a color filter and the like are formed. The first substrate and the second substrate overlap with each other with a constant gap therebetween. A sealing material is disposed in a frame shape between both of the substrates near the peripheral portion. Both of the substrates are bonded together with the sealing material, and at the same time liquid crystal is filled and sealed inside the sealing material between both of the substrates from a liquid crystal filling port disposed at a part of the sealing material. Further, a polarizer is bonded to outer surfaces of both of the substrates. Thus, the liquid crystal display panel 1 is formed.

The counter electrode CT is disposed on the second substrate side when the liquid crystal display panel is of a TN type or VA type, while being disposed on the first substrate side when it is of an IPS type.

The invention is irrelevant to the internal structure of the liquid crystal panel, and therefore the detailed description of the internal structure of the liquid crystal panel is omitted. Further, the invention is applicable to a liquid crystal panel of any structure.

The liquid crystal display device of the embodiments has a feature in that it can operate even under high-temperature environment exceeding 100° C., for example.

Hereinafter, each of the embodiments of the invention will be described.

First Embodiment

Figure 3:
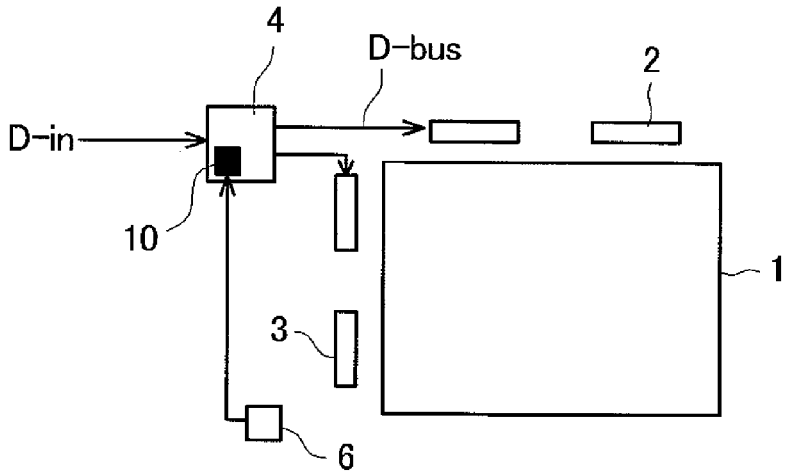
FIG. 3 is a schematic view for explaining a liquid crystal display device according to a first embodiment of the invention.

FIG. 3 is a schematic view for explaining a liquid crystal display device according to a first embodiment of the invention.

In the embodiment, a display bit reduction circuit 10 is disposed inside the display control circuit 4. When a temperature equal to or more than a predetermined temperature is detected at a temperature detecting sensor 6, the display bit reduction circuit 10 operates in a high-temperature operation mode. In the high-temperature operation mode, the display bit reduction circuit 10 ignores bits other than the highest-order bit of display data D-in input from an external apparatus, and sends data of the highest-order bit of the display data to the drain driver 2 as thinned data D-out.

Figure 4:
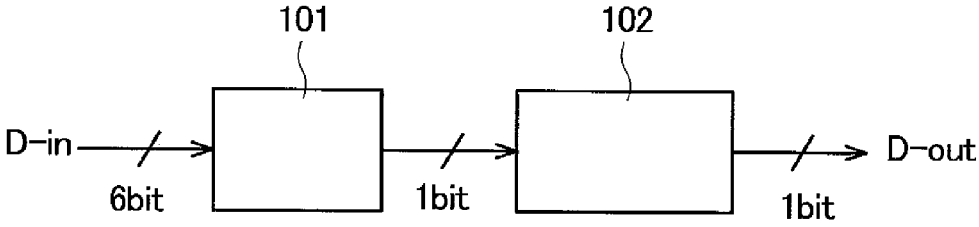
FIG. 4 is a block diagram showing a circuit configuration of a display bit reduction circuit shown in FIG. 3.

FIG. 4 is a block diagram showing a circuit configuration of the display bit reduction circuit 10 shown in FIG. 3.

For example, the display data D-in will be described in which a gray scale display of 6 bits for each color is generally performed. When a temperature equal to or more than a predetermined temperature is detected by the temperature detecting sensor 6, the display bit reduction circuit 10 operates in the high-temperature operation mode. In the case of operating in the high-temperature operation mode, a gray scale bit reduction circuit 101 ignores the lower-order 5 bits of the input video data D-in, and sends only the highest-order one bit to the drain driver 2 via a data processing circuit and output buffer circuit 102.

With this operation, in the embodiment, voltage levels of signal lines relating to the lower-order 5 bits inside the display control circuit 4, including the data bus between the display control circuit 4 and the drain driver 2, are fixed. Therefore, the charging and discharging of the signal lines for the lower-order 5 bits can be reduced to thereby suppress a rise in temperature of the display control circuit 4.

In the display of the liquid crystal display panel itself, the number of display colors is reduced. However, under high-temperature environment, display characteristics are not required, but emphasis is placed on displaying an image. Therefore, the reduction in the number of display colors is not a problem in an actual use state if for a short time as long as the lighting up of the liquid crystal display panel can be confirmed.

Second Embodiment

Figure 5:
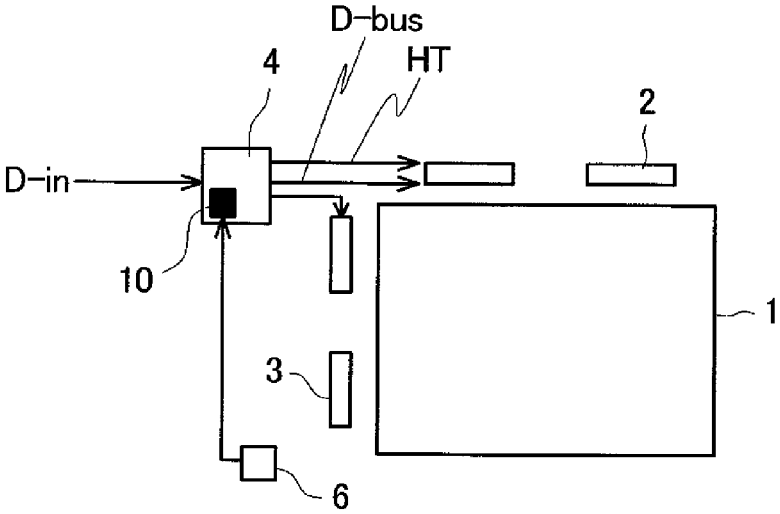
FIG. 5 is a schematic view for explaining a liquid crystal display device according to a second embodiment of the invention.

FIG. 5 is a schematic view for explaining a liquid crystal display device according to a second embodiment of the invention.

In the embodiment, a high-temperature operation signal HT indicative of the high-temperature operation mode is disposed between the display control circuit 4 and the drain driver 2. In FIG. 5, D-bus denotes a data bus for display data.

Figure 6:
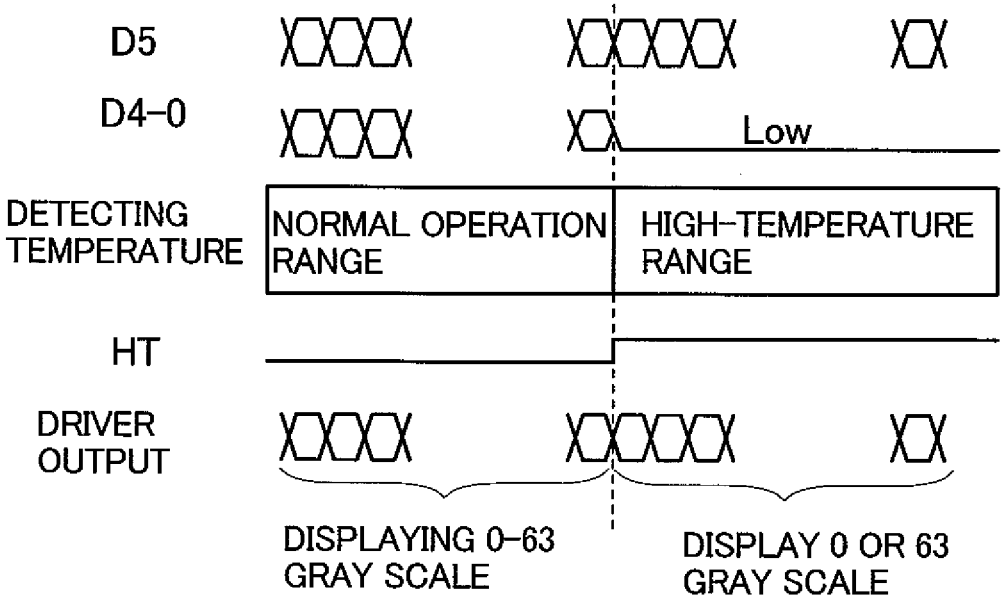
FIG. 6 shows an operation timing of the liquid crystal display device according the second embodiment of the invention.

FIG. 6 shows an operation timing according to the embodiment. In a normal operation range shown in FIG. 6, the drain driver 2 outputs voltage levels corresponding to 0 to 63 gray scales based on the bit values of display data D5 to D0.

In the high-temperature operation mode shown in FIG. 6, that is, in the case where a temperature equal to or more than a predetermined temperature is detected by the temperature detecting sensor 6, the high-temperature operation signal HT is at High level. Further, the display control circuit 4 fixes the bit values of the display data D4 to D0 at Low level. In this state, the drain driver 2 without the high-temperature operation signal HT can only output a voltage level corresponding to 0 gray scale or 63 gray scale in accordance with the value of the highest-order bit D5. On the other hand, when the high-temperature operation signal HT is disposed, the output of 63 gray scale which is the highest gray scale can be selected because of the condition of the high-temperature operation signal HT at High level in addition to the information of the highest-order bit D5 at High level (D5=1). Therefore, a voltage level corresponding to the highest gray scale or the lowest gray scale can be output with only one bit of the highest-order bit D5 for each pixel.

In the embodiment, the display control circuit 4 may fix the bit values of the display data D4 to D0 at High level.

Next, a circuit which outputs a gray scale voltage corresponding to the highest luminance or the lowest luminance described above will be described by using FIG. 7.

Figure 7:
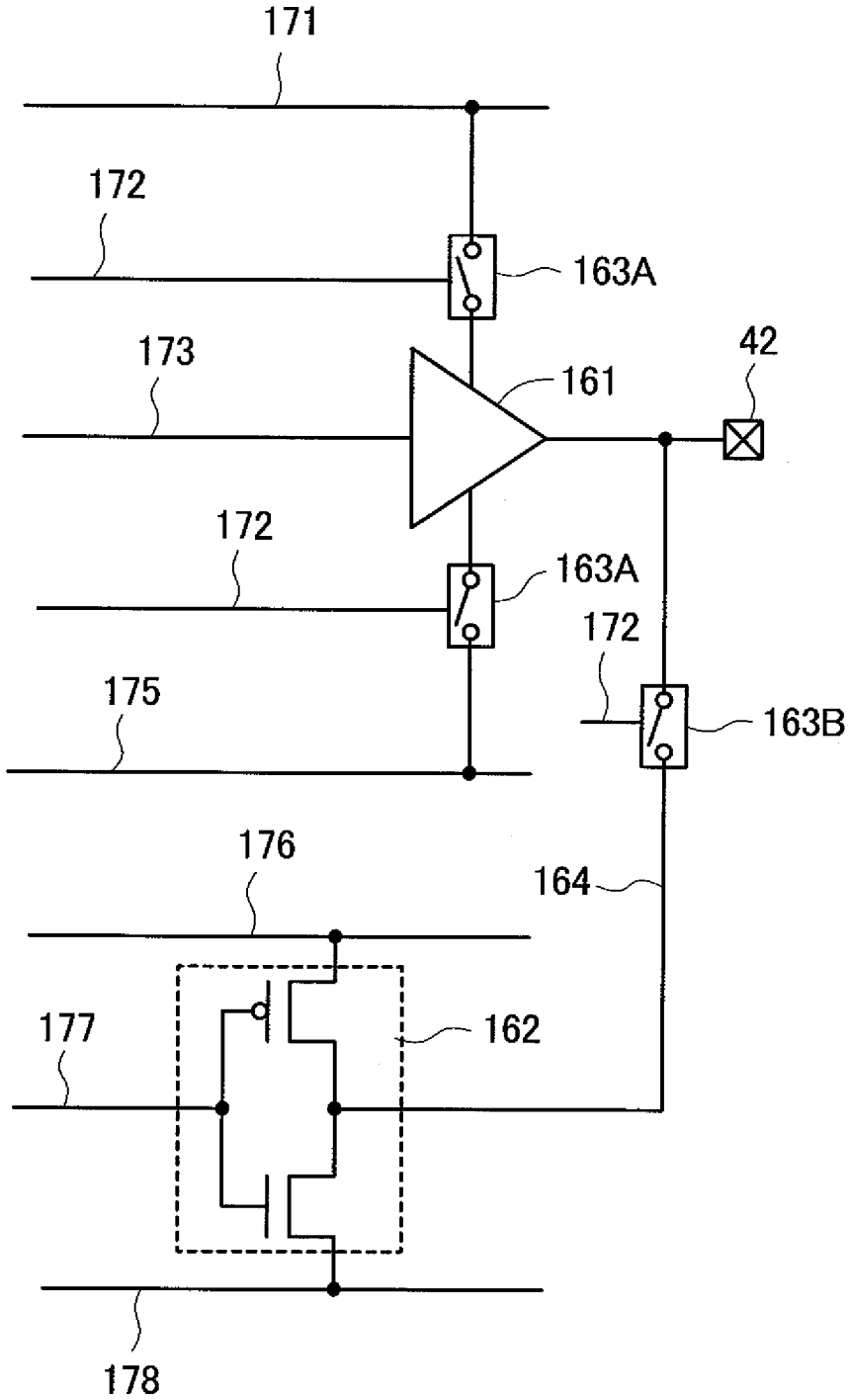
FIG. 7 is a circuit diagram showing a circuit configuration of a circuit which outputs a gray scale voltage corresponding to the highest luminance or the lowest luminance according to the second embodiment of the invention.

Reference numeral 161 in FIG. 7 denotes an output amplifier disposed inside the drain driver 2. In a normal operation, a gray scale voltage output from a decoder circuit is input to the output amplifier 161 via a voltage line 173. The output amplifier 161 current-amplifies the gray scale voltage and outputs the voltage to a video line 42. At this time, an output of an output inverter 162 is cut off from the video line 42 by a switching element 163B.

In the case of the high-temperature operation mode, the operation of the output amplifier 161 is stopped, and a voltage corresponding to the highest luminance or the lowest luminance is output from the output inverter 162, whereby a rise in temperature of the circuit can be suppressed.

That is, in the high-temperature operation mode, the connection of power supply lines 171 and 175 to the output amplifier 161 is cut with control signal lines 172 by using switching elements 163A to stop the operation of the output amplifier 161. Further, the output inverter 162 is connected to the video line 42 by using the switching element 163B.

At this time, since the transfer of display data is also unnecessary, the operation of the decoder circuit is stopped, and only the value of the highest-order bit of display data is output from a latch circuit. By using the highest-order bit of the display data output from the latch circuit, in the case where the highest-order bit is "1", a voltage of Low level is supplied to a signal line 177, and a voltage supplied from a power supply line 176 is output from the output inverter 162. In the case where the highest-order bit is "0", a voltage of High level is supplied to the signal line 177, and a voltage supplied from a power supply line 178 is output from the output inverter 162. A maximum gray scale voltage V63 is supplied to the power supply line 176 of the output inverter 162, while a minimum gray scale voltage V0 is supplied to the power supply line 178.

For example, in the case of a normally white mode, the maximum gray scale voltage is output for the lowest luminance, while the minimum gray scale voltage is output for the highest luminance. Accordingly, in the case of the lowest luminance in the normally white mode, the value of the highest-order bit is once inverted to supply a voltage of Low level to the signal line 177, whereby the maximum gray scale voltage V63 is output to the video line 42. In the case of the highest luminance, a voltage of High level is supplied to the signal line 177, whereby the minimum gray scale voltage V0 is output to the video line 42. The operation of the latch circuit and a level shift circuit can be partially stopped as needed.

In the above description, the gray scale voltage output to the video line 42 has been described as being a positive-polarity voltage which is higher in potential than a counter voltage input to the counter electrode CT. However, the embodiment can be implemented with a similar circuit configuration also in the case where the gray scale voltage output to the video line 42 is a negative-polarity voltage which is lower in potential than the counter voltage input to the counter electrode CT.

In the case of a negative-polarity voltage, however, it is necessary that the minimum gray scale voltage V0 be supplied to the power supply line 176 of the output inverter 162, while that the maximum gray scale voltage V63 be supplied to the power supply line 178.

Third Embodiment

Figure 8:
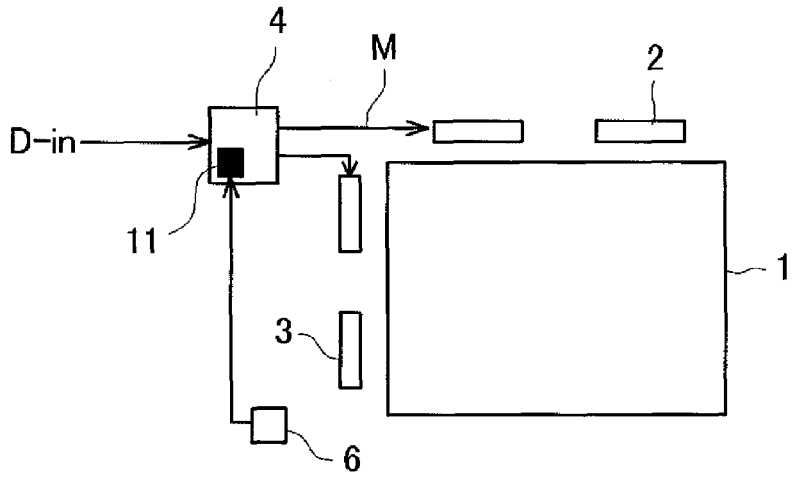
FIG. 8 is a schematic view for explaining a liquid crystal display device according to a third embodiment of the invention.

FIG. 8 is a schematic view for explaining a liquid crystal display device according to a third embodiment of the invention.

In the embodiment, in the high-temperature operation mode when a temperature equal to or more than a predetermined temperature is detected at the temperature detecting sensor 6, the period of an alternating signal M generated in alternating signal generating means 11 inside the display control circuit 4 is reduced.

Figure 9:
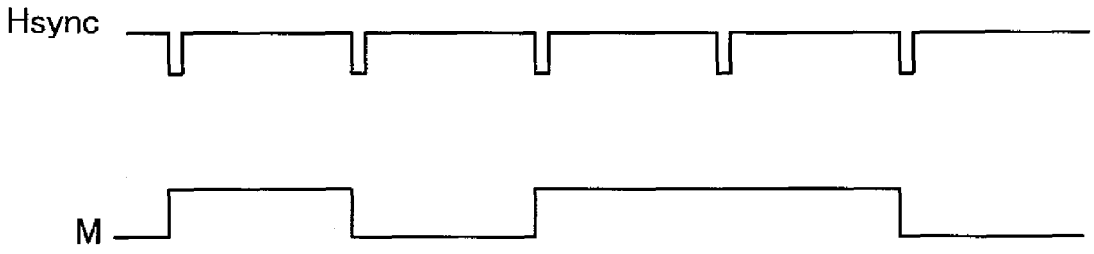
FIG. 9 shows an operation timing of the liquid crystal display device according to the third embodiment of the invention.

FIG. 9 shows an operation timing of the liquid crystal display device according to the embodiment.

In the case where a temperature detected by the temperature detecting sensor 6 is low, the alternating period of the alternating signal M is set for one line, and AC conversion is performed with a period for every line in synchronization with one horizontal synchronizing signal Hsync. When a temperature equal to or more than a predetermined temperature is detected at the temperature detecting sensor 6, for example, the alternating period of the alternating signal M is set for two lines, and AC conversion is performed with a period for every two lines in synchronization with every other horizontal synchronizing signal Hsync.

With this operation, since the power consumption of the power supply circuit which supplies the charging and discharging current of the liquid crystal capacitance LC can be reduced, a rise in temperature in that portion can be suppressed, and as a result, the use even under high-temperature environment is possible.

Fourth Embodiment

Figure 10:
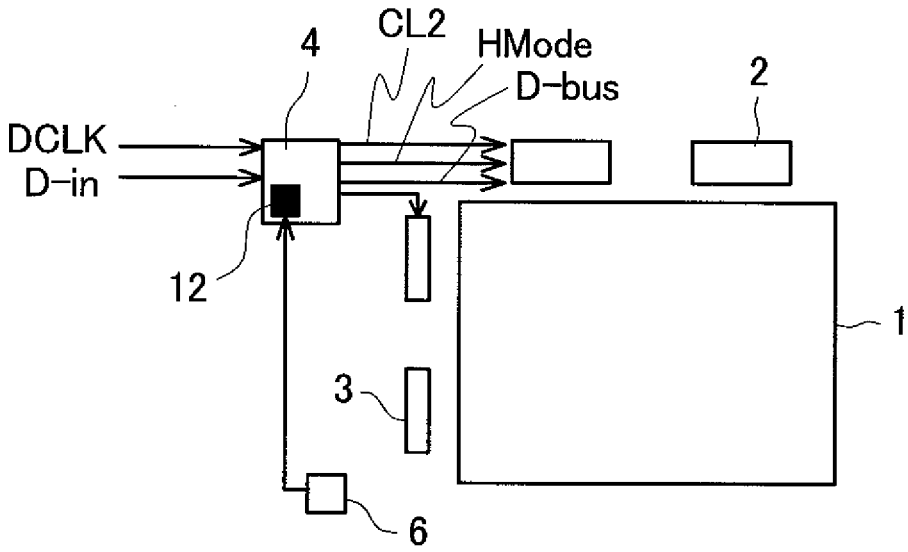
FIG. 10 is a schematic view for explaining a liquid crystal display device according to a fourth embodiment of the invention.

FIG. 10 is a schematic view for explaining a liquid crystal display device according to a fourth embodiment of the invention.

In the embodiment, a data thinning circuit 12 is disposed inside the display control circuit 4. In the high-temperature operation mode when a temperature equal to or more than a predetermined temperature is detected at the temperature detecting sensor 6, the data thinning circuit 12 thins display data and sends the display data to the drain driver 2. Further, the display control circuit 4 sends a data thinning signal Hmode indicative of the state to the drain driver 2 during a thinning operation.

Figure 11:
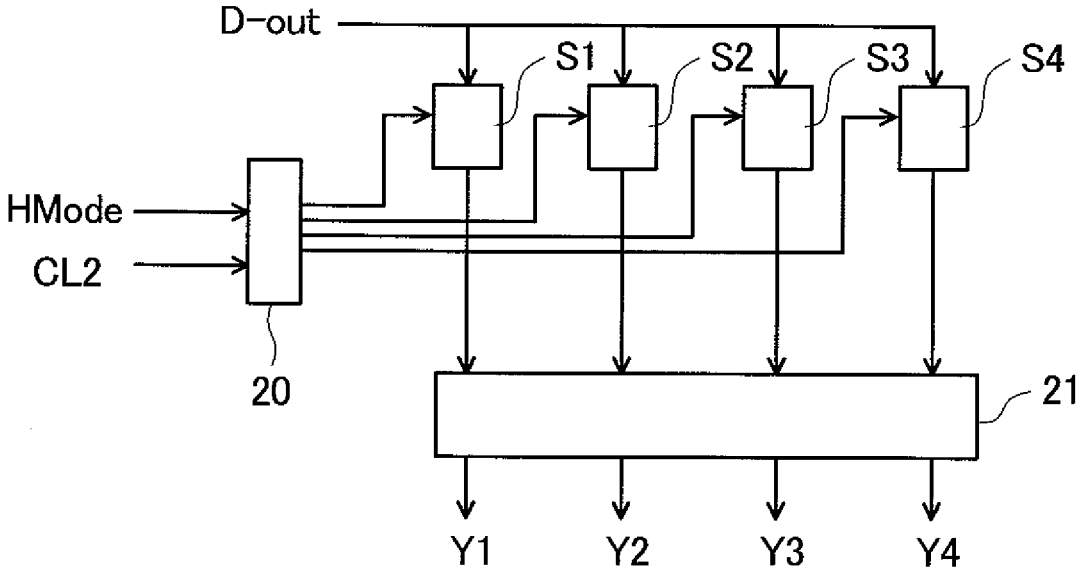
FIG. 11 is a schematic view for explaining an example of a drain driver 2 according to the fourth embodiment of the invention.

FIG. 11 is a schematic view for explaining an example of the drain driver 2 according to the embodiment.

In FIG. 11, 20 denotes a clock distribution circuit, 21 denotes a voltage selection and output circuit, Y1, Y2, Y3, and Y4 denote video lines, and S1 to S4 denote latch circuits.

Figure 12:
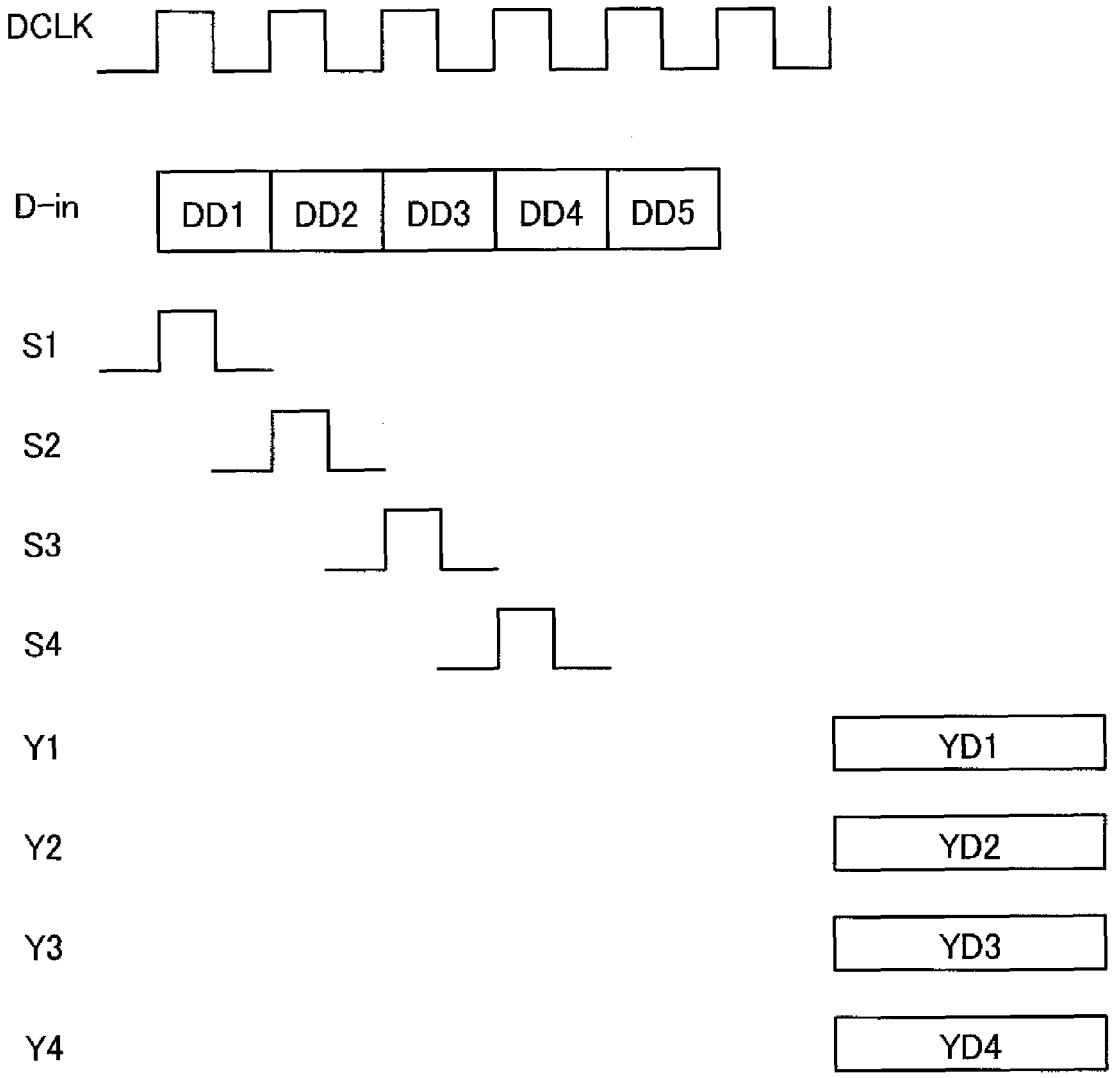
FIG. 12 is a timing chart in a normal operation according to the fourth embodiment of the invention.

FIG. 12 is a timing chart in a normal operation according to the embodiment.

In the normal operation, the display-data-latch clock signal CL2 synchronized with the dot clock DCLK input from an external apparatus is supplied from the clock distribution circuit 20 to the latch circuits S1 to S4 corresponding to the video lines Y1, Y2, Y3, and Y4. Display data DD1 to DD5 are sequentially captured by the latch circuits S1 to S4 one pixel by one pixel. After the capturing of the display data amounting to one line is completed, voltages YD1 to YD4 corresponding to the data are output from the voltage selection and output circuit 21 to the video lines Y1 to Y4.

Figure 13:
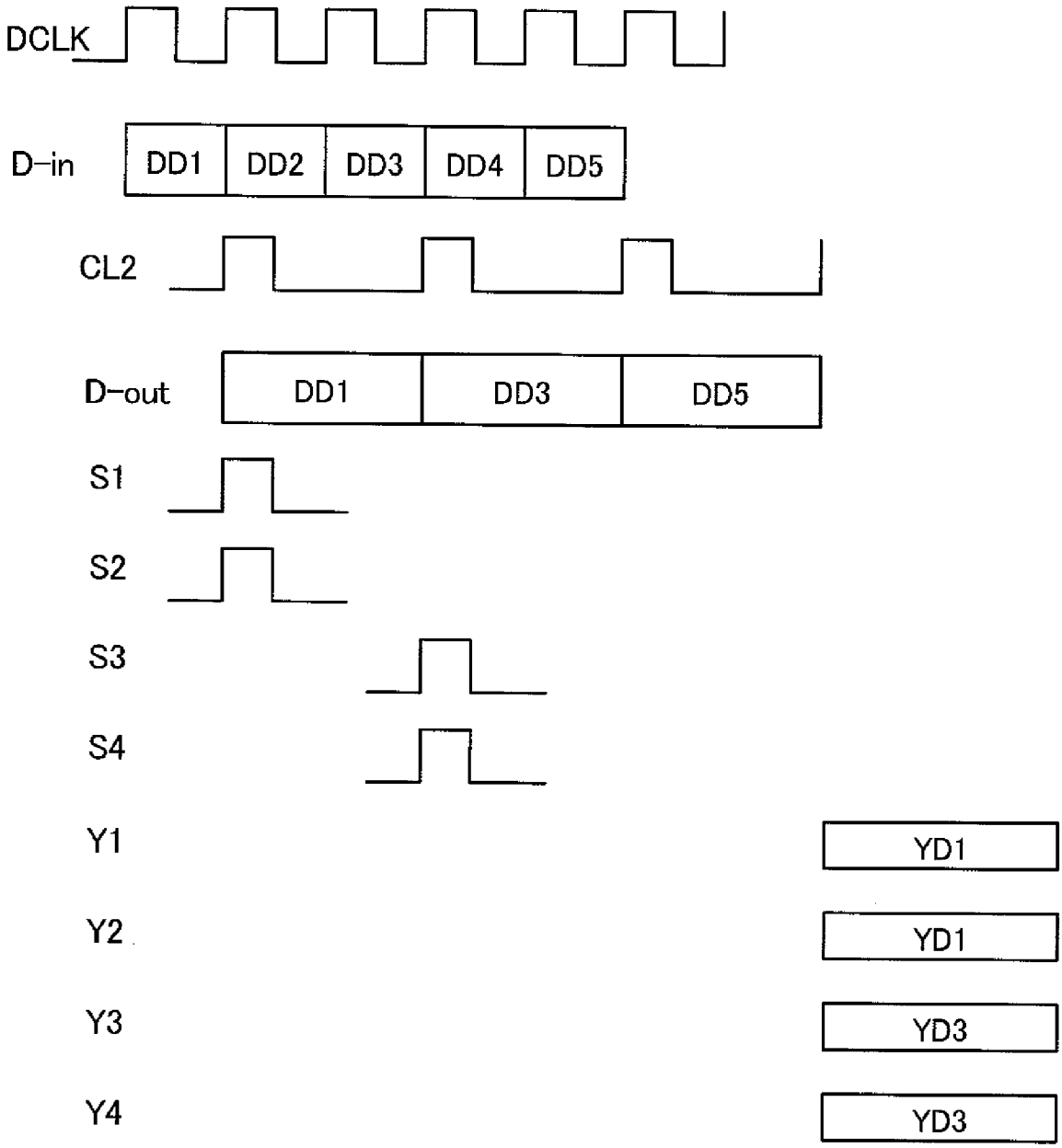
FIG. 13 is a timing chart showing an operation in a thinning mode according to the fourth embodiment of the invention.

FIG. 13 is a timing chart showing an operation in a thinning mode according to the embodiment.

In the thinning mode, for example, the drain driver 2 performs an operation for capturing the same display data every two adjacent video lines. That is, in the thinning mode, the display-data-latch clock signal CL2 is supplied from the clock distribution circuit 20 to the latch circuits S1 and S2 or S3 and S4 corresponding to two adjacent video lines Y1 and Y2 or Y3 and Y4.

Then, the display data DD1 is captured by the latch circuits S1 and S2, and similarly, the display data DD3 is captured by the latch circuits S3 and S4. Accordingly, after the capturing of the display data amounting to one line is completed, the voltage YD1 corresponding to the display data DD1 and the voltage YD3 corresponding to the display data DD3 are output from the voltage selection and output circuit 21 to the video lines Y1 and Y2 and the video lines Y3 and Y4, respectively.

With this operation, the current image can be displayed while decreasing the clock frequency of the clock signal CL2 between the display control circuit 4 and the drain driver 2 and the data transfer frequency, and thinning the display data of the current image. Therefore, the power consumption of the charging and discharging of the video lines can be reduced, and a rise in temperature of the display control circuit 4 can be suppressed.

Fifth Embodiment

Figure 14:
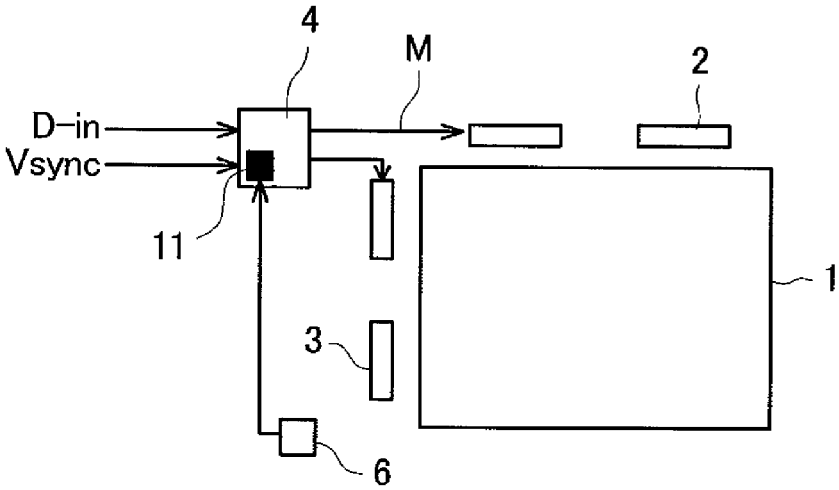
FIG. 14 is a schematic view for explaining a liquid crystal display device according to a fifth embodiment of the invention.
Figure 15:
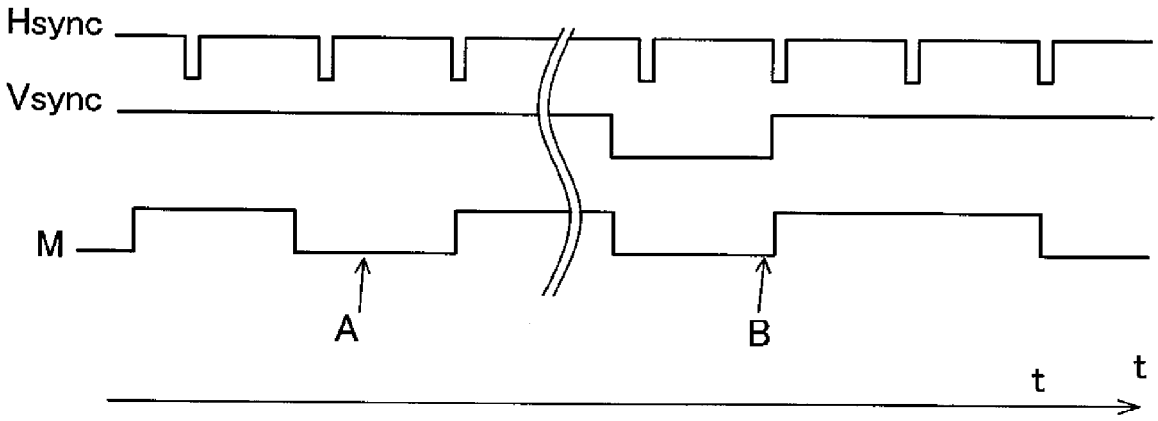
FIG. 15 shows an operation timing of the liquid crystal display device according to the fifth embodiment of the invention

FIG. 14 is a schematic view for explaining a liquid crystal display device according to a fifth embodiment of the invention. FIG. 15 shows a timing chart of switching according to the embodiment.

The embodiment is to prevent the distortion of an image at the time of switching from the normal operation to the high-temperature operation mode by switching between the normal operation and the high-temperature operation mode when frames are switched in the third embodiment.

That is, in the display control circuit 4, the vertical synchronizing signal Vsync is monitored, and the normal operation and the high-temperature operation mode are switched to each other when frames are switched as shown at point B in FIG. 15 when a temperature equal to or more than a predetermined temperature is detected at the temperature detecting sensor 6 at point A in FIG. 15, for example. With this operation, in the embodiment, the distortion of an image at the time of switching from the normal operation to the high-temperature operation mode can be prevented.

In the above-described embodiments, the switching from the normal operation to the high-temperature operation mode may be performed in synchronization with the vertical synchronizing signal Vsync. Similarly, the switching from the high-temperature operation mode to the normal operation mode can be performed when frames are switched or in synchronization with the vertical synchronizing signal Vsync.

As has been described above, according to the embodiment, a rise in the ambient temperature of the liquid crystal display device is detected to partially stop the operation of an IC circuit and decrease an operation frequency, whereby a rise in temperature of a circuit component can be suppressed. Therefore, operation even under high-temperature environment is possible.

In the above-described embodiments, the temperature detecting sensor 6 is arranged near an IC which is required to operate under high-temperature environment, for example, mounted on a substrate on which an IC and the like which are required to operate under high-temperature environment are mounted, or on the first substrate on which the pixel electrodes PX, the thin film transistors TFT, and the like are formed.

In the above description, although the embodiments have been described in which the invention is applied to a liquid crystal display device, the invention is not limited thereto. It is needless to say that the invention can be applied to, for example, an electroluminescent display device using an organic electroluminescent element.

While the invention made by the inventor has been specifically described so far based on the embodiments, the invention is not limited to the embodiments. It is apparent that the invention can be modified variously within a range not departing from the gist thereof.

What is claimed is:

1. A display device comprising:

a display panel having a plurality of pixels;

a drive circuit supplying a drive voltage to the plurality of pixels;

a display control device supplying display data to the drive circuit;

a temperature detecting sensor; and a display bit reduction circuit, wherein a high-temperature operation mode is set by the temperature detecting sensor in the case where a temperature equal to or more than a predetermined temperature is detected, the display bit reduction circuit configured to supply only the highest-order bit of display data as a control signal to the drive circuit in the high-temperature operation mode to reduce power consumption of the display device to suppress a rise in temperature of the display device in the high-temperature operation mode, the drive circuit includes an amplifier circuit which outputs a gray scale voltage based on display data, and an output inverter which sets one power supply voltage to a maximum gray scale voltage and sets another power supply voltage to minimum gray scale voltage, and a control signal line electrically connected between the display bit reduction circuit and the drive circuit to transmit the control signal to the drive circuit to stop operation of the amplifier circuit and to connect the output inverter to an output of the drive circuit when the display device is in the high-temperature operation mode.

2. The display device according to claim 1, wherein the display control device transmits a high-temperature operation signal indicative of the high-temperature operation mode to the drive circuit, the display bit reduction circuit fixes bits other than the highest-order bit of display data to "0" or "1" due to the high-temperature operation signal and sends the display data to the drive circuit, and the drive circuit outputs the maximum gray scale voltage corresponding to the highest luminance or the minimum gray scale voltage corresponding to the lowest luminance when notified of the high-temperature operation signal.

* * * * *